United States Patent [19]

Beaune

[11] 4,267,028

[45] May 12, 1981

[54] PROCESS FOR SMOOTH CUT PRINTING

[76] Inventor: Daniel Beaune, La Prunerie, Marsac sur l'Isle (Dordogne), France

[21] Appl. No.: 872,451

[22] Filed: Jan. 26, 1978

[30] Foreign Application Priority Data

Jan. 28, 1977 [FR] France ..... 77 02505

[51] Int. Cl.[3] ..... C25D 13/06; C25D 13/12

[52] U.S. Cl. ..... 204/181 R; 101/401.1; 204/17

[58] Field of Search ..... 204/15, 17, 181 R; 101/457, 465, 167, 401.1

[56] References Cited

U.S. PATENT DOCUMENTS

| | | | |
|---|---|---|---|
| 1,878,565 | 9/1932 | Woodbury | 101/167 X |
| 3,741,835 | 6/1973 | Giori | 204/17 X |
| 3,886,103 | 5/1975 | Koizumi et al. | 204/181 R X |
| 3,898,145 | 8/1975 | Davis et al. | 204/181 R |
| 3,910,187 | 10/1975 | Cords | 101/457 X |

*Primary Examiner*—Evan K. Lawrence
*Attorney, Agent, or Firm*—Wolf, Greenfield & Sacks

[57] ABSTRACT

A process for smooth cut printing wherein the non-printing surfaces of the plate carrying the smooth cuts of the engraving are coated with at least a layer anti-adhesive towards printing inks formed by electrolytically depositing a solid fluorocarbonaceous resin on the non-printing surfaces.

2 Claims, 7 Drawing Figures

PROCESS FOR SMOOTH CUT PRINTING

BACKGROUND OF THE INVENTION

The present invention provides a process for smooth cut printing.

The usual processes for smooth cut printing of documents consist in using a thin plate, a shell, a collar or a cylinder, all of them called plate in the following description, preferably made of metal wherein the pattern to be reproduced through printing is sunk engraved. Some areas of said plate are coated with ink so that the ink penetrates the hollows or cuts of same. The inked surface is wiped out in order to leave ink in the hollows only and the surface thus inked and wiped out is applied against an appropriate support, such as a sheet or a strip of paper, by means of a pressing cylinder; thus, a part of the ink is transferred from the hollows onto the sheet.

According to some processes, an indirect transfer of the ink contained in the hollows of the plate is performed by means of a cylinder carrying a flexible coating and positioned between the plate and the support.

In the known processes, the wiping operation causes a great loss of ink. As a matter of fact, the coating of the engraved plate with ink is performed at 100%, and the wiping thereof removes, depending on the case, about 75% of said ink; this corresponds to the parts of the area which do not carry any cut and do not serve for printing. Said 75% of wiped ink constitute wastes. Where a printing with several colors is involved by using one and the same plate each zone of which receives inks of different colors, the waste problems remain. Furthermore, in view of the wiping, the risk is run of running one color into another one and also of mixing colors which spoils the quality of the print.

A process and a machine for smooth cut printing is already known and disclosed in French Pat. No. 1,564,653.

Said process consists in coating the plate before inking it, with a colorless liquid, non-miscible with ink, then in applying the ink. Generally, the non-miscible liquid is filtered water.

Such an improvement to standard processes is aimed to minimise the losses of ink and to increase the sharpness of the printed patterns, as well as to prevent or simplify the wiping operation.

Unfortunately, the practice has shown that this process which rests on a physical balance between the water and ink is suitable only for a given depth of the cut and not for all depths of smooth cuts with various depths as most of them. This greatly limits the scope of the process and practically prevents its use.

SUMMARY OF THE INVENTION

The purpose of the present invention is to remedy these drawbacks and to provide a process for smooth cut printing which makes it possible to save a large quantity of printing ink, as well as the accessory cleaning products, etc . . . used for printing, and to prevent all the wiping operations which not only result in a loss of ink but furthermore gives rise to the risk of mixing inks of various colors or leaving trails.

To this end, the present invention provides a process of the same type as that referred to hereabove, wherein the non-printing surfaces of the plate carrying the smooth cuts of the engraving are coated with at least a layer anti-adhesive towards printing inks. Preferably, said layer consists of a fluorocarbonasceous resin laid down in particular through electrolysis (electrolytic deposition).

Thanks to this process, the engraved plate is coated only with the quantity of ink required to fill in engravings, without any excess of ink on the non-engraved surfaces which will thus performe no printing.

According to a further characteristic of the invention, so as to lay down said anti-adhesive layer, the cuts of the engraving of the plate are obturated with a non-electricity conductor material. The solid anti-adhesive layer is laid down through electrolysis and the material obstructing the cuts of the engraving dissolved.

So as to better improve the ink output of this process, the solid anti-adhesive layer consisting for example of a fluorocarbonasceous resin can be covered with a very thin layer of a greasy product preferably based on organosilicic by-products so as to complete the anti-adherent characteristics of the non-printed surface of the plate.

Saving of ink according to the process referred to hereabove is considerable and corresponds depending on the cuts involved to a saving ranging from 300 to 400%. As a matter of fact, while 100% of ink is used, according to standard processes 25% only really serves for printing and 75% constitutes wastes, in the process according to the present invention the ink is fully used. This means that according to said process, a quarter or a third part of ink is sufficient in relation to the quantity of same required in standard processes.

Furthermore, this process makes it possible to save the cleaning products of the wiper cylinder. Now, as these products, as well as inks used, are onerous, this results in a most important saving.

According to another characteristic of the invention, the plate is coated with printing ink and said ink is compacted in the cuts of the engraving. Said compacting is performed by means of a compacting cylinder the purpose of which is only to remove any slight surplus of ink in the engravings and to push it down to the bottom of said engravings by opposing the superficial tension forces so that the meniscus formed by the ink contained in engravings be slightly concave, which is a compulsory condition for obtaining a sharp engraving.

BRIEF DESCRIPTION OF THE DRAWINGS

The present invention will be described with more details by means of the drawings attached thereto, wherein.

DETAILED DESCRIPTION

Figure 1:
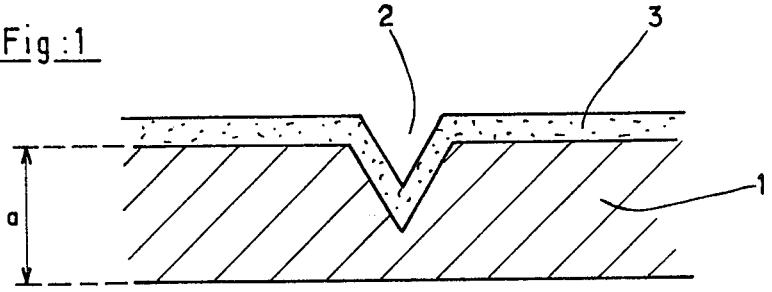
FIG. 1 is a diagrammatical cross-section view, at an enlarged scale, of a plate used for a smooth cut printing, according to the Prior Art.

FIG. 1 is a cross-section view of a standard printing plate 1 made of metal whose thickness is referenced a. Said plate may be a thin plate, a shell, a collar or a cylinder. The cross-section view of the plate diagrammatically shows only one cut 2 of the engraving.

All the surface of said plate is generally coated with a layer of chromium 3 which protects the plate against the corrosion of the ink.

According to the process provided by the invention, a film of a liquid anti-adhesive material, or a layer of a solid anti-adhesive material with or without a second liquid anti-adhesive layer are laid down onto the plate.

The following description refers to the case of a plate coated with a solid anti-adhesive layer and with a liquid anti-adhesive layer too.

Figure 2:
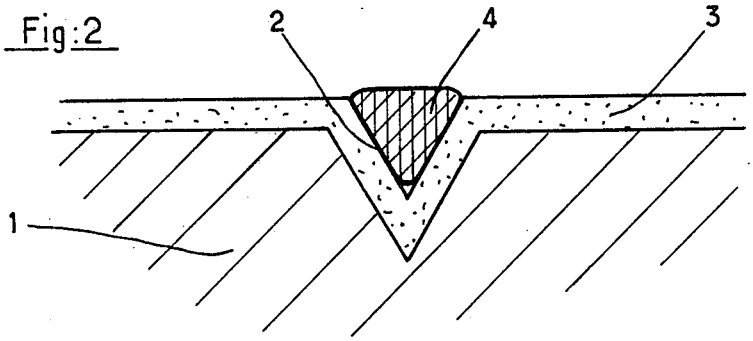
FIG. 2 is a cross-section view, at an enlarged scale, of a cut of the engraving obturated with a varnish non-conductor of electricity.

As a matter of fact, as shown in FIG. 2, after having made a cut 2 in the plate 1, and after having deposited a layer of chromium 3 onto the surface of the plate 1 and inside the cut 2, said cut 2 is obturated by means of a mass such as a varnish non-conductor of electricity or with any other materials non-conductor of electricity. It is preferable to use a varnish capable to easily dissolve in usual solvents such as, for example, methyl-ethylcetone, trichlorethylene, etc.

Figure 3:
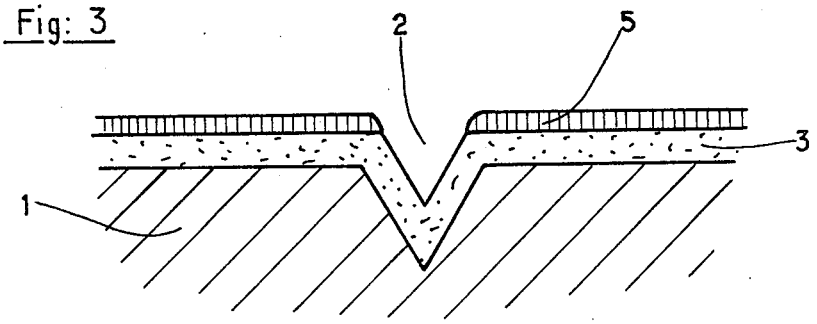
FIG. 3 is a cross-section view, at an enlarged scale, of a cut of the engraving after the electrolytic deposit of the anti-adhesive layer and the dissolution of the varnish.

As shown in FIG. 3, after solidification of the mass 4, the plate 1 is degreased and covered through electrolyse or, generally, by coating it with a thin layer 5 (ranging, for example, from 5 to 20 microns); said layer 5 is a layer to which printing inks do not adhere, such as a synthetic resin and, particularly, a fluorocarbonasceous resin. Then, the whole is dipped in a bath of solvent so as to dissolve the material 4 obstructing the cut 2. The filling material 4 contained in the cuts 2 of the engraving is dissolved. Thus, the surface of the plate 1 is coated with a layer of an anti-adhesive material 5 while the sides and the bottom of the cut 2 carry only the layer of chromium 3 or any other protecting layer.

Figure 4:
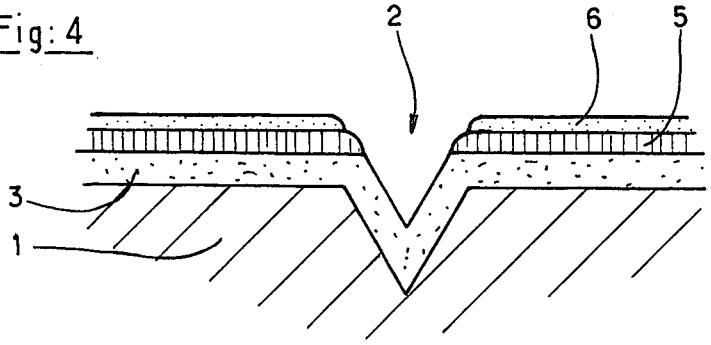
FIG. 4 is a diagrammatical cross-section view of a cut of the engraving, similar to FIG. 3, after the application of the second anti-adhesive layer.

As shown in FIG. 4, the surface of the plate 1 is covered, should it be necessary, with the exception of the cut 2, with a second anti-adhesive layer 6 such as, for example, a thin layer of a greasy product preferably based on organo-silic by-products so that the surface of the plate 1 which do not perform any print be perfectly anti-adhesive towards inks.

Said layer 6 may be deposited through coating before the plate is inked.

Figure 5:
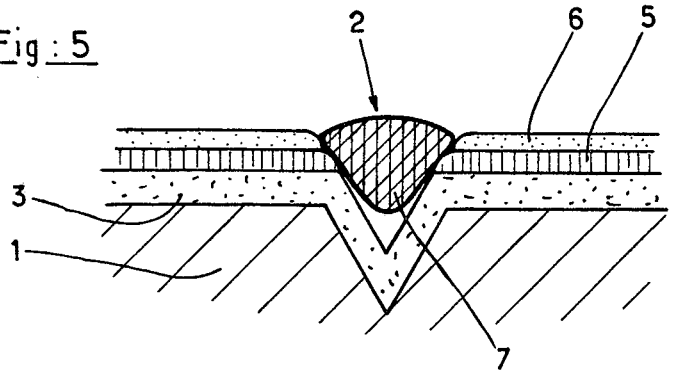
FIG. 5 is a diagrammatical cross-section view, at an enlarged scale, or a cut of the engraving after inking of same.

As shown in FIG. 5, when inking is performed, a certain quantity of ink 7 goes into the cut 2 but not on the anti-adhesive layer or layers 5, 6 which push back the ink.

Figure 6:
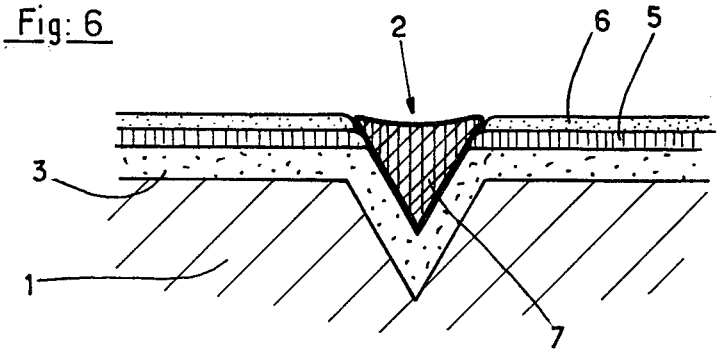
FIG. 6 is a cross-section view, at an enlarged scale, of a cut of the engraving after compacting of the ink.

In order to ensure a good printing, without any overflow, the ink 7 contained in the cut 2 must show a concave meniscus; so as to achieve such a meniscus 7', the ink 7 is driven into the cut 2 as shown in FIG. 6. To perform said driving in, a means of compression is used which removes said ink from the cut 2 by removing any cavity which could exist between the ink 7 formerly deposited and the walls of said cut 2.

Figure 7:
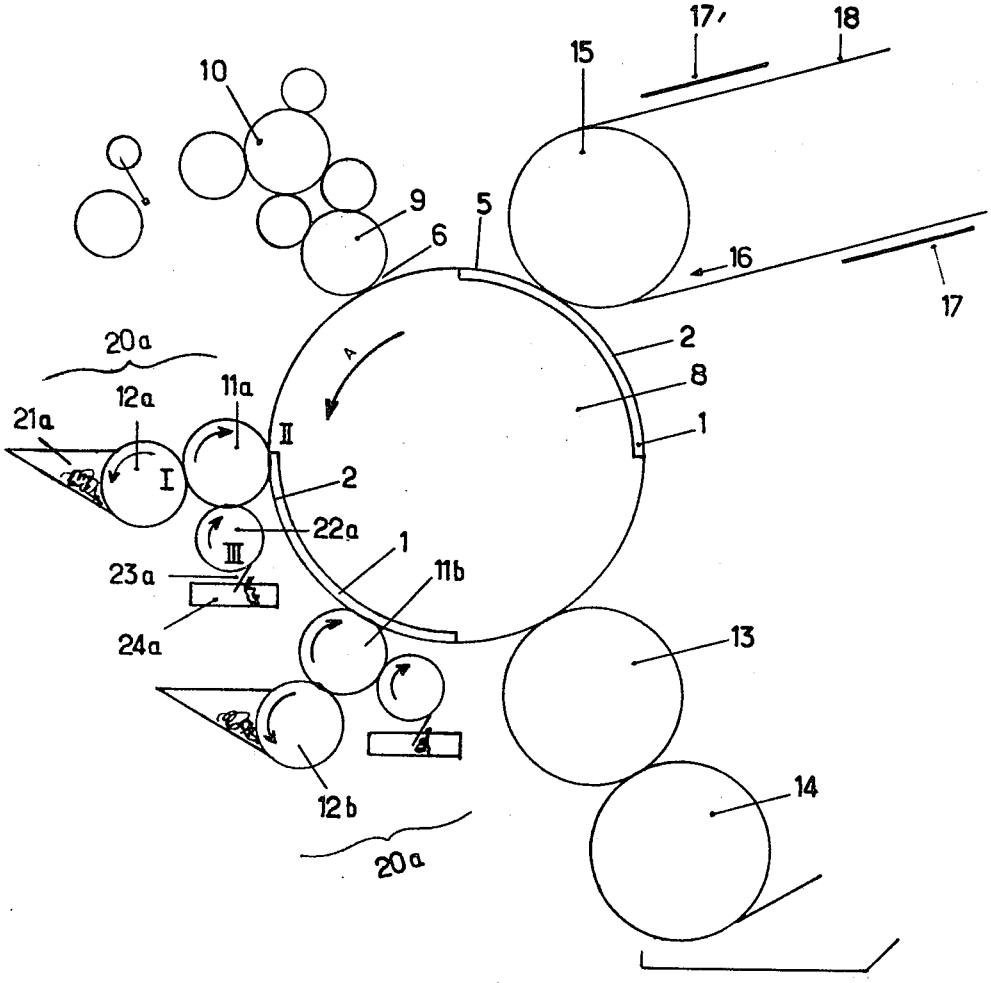
FIG. 7 is a diagrammatical view of a smooth cut printing machine for working out the process.

As shown in FIG. 7, the machine for working out the process disclosed hereabove consists of a rotating cylinder 8 the whole surface of which carries at least a thin plate 1 carrying sink engravings 2 outlining the pattern to be reproduced through printing; said plate is coated, according to the invention with a solid anti-adhesive layer 5. Said plate 1 is permanently fed by as much ink applier groups 20*a*, 20*b* as there are various colored inks to be applied. Said ink applier groups 20*a*, 20*b*, as well as the manner in which they work, will be described with more details hereafter. Nevertheless, it is to be stressed that the Figure shows two ink applier groups; obviously, said number could be different without therey departing from the scope of the invention.

A printing cylinder 15 designed to apply the sheets of paper to be printed 17 against the plates 1 is associated with a means providing blank sheets of paper 17. As soon as they are printed, said sheets 17' are moved away by a clearing means 18. The feeding means 16 and clearing means 18 for the sheets of paper 17 and 17' are very diagrammatically shown and may correspond to any similar devices currently used.

Furthermore, and as shown in FIG. 1, the machine carries upstream of the ink applier groups 20 in the rotating direction of the cylinder 8 according to arrow A, an applier cylinder 9 for the liquid anti-adhesive layer 10. Said applier cylinder 9 is combined with a mechanism for dosing and levelling the ink 10.

Furthermore, said machine carries downstream of the ink appliers 20 a contacting cylinder 13 which turns in perfect synchronization with the surface of the plate 1 and which is combined with a system for recovering the ink 14. Means, not shown, make it possible to strongly apply the cylinders which apply the anti-adhesive products 9, the ink applier groups 20 and the printing cylinders 15 against the cylinder 8 which supports the plates 1. In addition, said machine carries a means not shown for driving the cylinders in rotation.

As shown in this Figure, each ink applier group 20*a* consists of an applier cylinder properly speaking 11*a* cut in function of the areas of the plates 1 to be inked, of a feeding cylinder or again of the ink applier cylinder 12*a* tangent to the ink applier cylinder 11*a* which turns in the opposite direction, and associated with an ink storage tank 21*a*, as well as of a cleaning means designed to remove from the ink applier cylinder 11*a* any trace of anti-adhesive product.

Said cleaning means consists of a cleaning cylinder 22*a* rotating in the same direction as the ink applier cylinder 11*a* which partly wipes it and recovers the mixture ink-anti-adhesive product so as to take it towards scraping device 23*a* which deposits in into a vessel 24*a*.

Said ink applier group 20*a* works as follows:

- the fresh ink coming from the ink storage tank 21*a* is deposited in thin thickness onto the feeding cylinder 12*a* and transmitted to the ink applier cylinder 11*a* cut at point I. The areas in relief of the roller 11*a* thus inked will at point II deposit some ink inside the cuts 2 of the engraving carried by the plate 1.

Between the cuts 2 of the plates 1, on the surface of said plates 1, the liquid anti-adhesive product 6 applied by the cylinder 9 tends to mix up with the ink. If said mixture would not be stopped by the cleaning cylinder 22*a*, it would go up to the point I on the feeding cylinder 12*a* and would thus spoil the fresh ink. Such a spoiled ink would deposit inside the cuts 2 of the engraving during the following run.

The cylinder 22*a* which rotates in the same direction as the roller 11*a* partly wipes the surface thereof and drives the mixture anti-adhesive product and ink towards the point III where the scraping device 22*a* recovers it to take it into the vessel 24*a*.

Thus, the ink which has been mixed up with little anti-adhesive product 5 does not run the risk of mixing up with the fresh ink spread over the feeding cylinder 12*a* and thus of spoiling the printing.

Of course, the invention is not limited to the mode of embodiment disclosed and represented hereabove, from which other modes and forms of embodiment can be provided without thereby departing from the scope of the invention.

What I claim is:

1. A process for smooth cut printing with a metal printing plate having an engraved portion of smooth cuts and a non-printing surface, said process comprising the steps of;

obstructing the engraved portion with an electrically nonconductive material, coating the non-printing surface of the plate with at least a layer anti-adhesive towards printing inks formed by electrolytically depositing a solid fluorocarbonaceous resin on said non-printing surface, removing the electrically non-conductive material from the engaved cut, coating the plate with a printing ink, and compacting the ink into the cuts of the engraving.

2. A process as set forth in claim 1 wherein the coating step comprises the steps of depositing said solid anti-adhesive layer followed by depositing a liquid anti-adhesive layer or said solid layer.

* * * * *